US007052416B2

(12) United States Patent
Chang

(10) Patent No.: US 7,052,416 B2
(45) Date of Patent: May 30, 2006

(54) GOLF RANGE TEE

(76) Inventor: Rea Tower Chang, 14252 Culver Dr., A722, Irvine, CA (US) 92620

( * ) Notice: Subject to any disclaimer, the term of this patent is extended or adjusted under 35 U.S.C. 154(b) by 0 days.

(21) Appl. No.: 10/916,350

(22) Filed: Aug. 10, 2004

(65) Prior Publication Data

US 2006/0035728 A1 Feb. 16, 2006

(51) Int. Cl.
*A63B 57/00* (2006.01)

(52) U.S. Cl. ..... 473/396; 473/400

(58) Field of Classification Search ..... 473/386–403, 473/257, 278

See application file for complete search history.

(56) References Cited

U.S. PATENT DOCUMENTS 1,783,211 A * 12/1930 Baldwin ..... 473/257
3,203,700 A * 8/1965 Antonious ..... 473/398
4,181,311 A * 1/1980 Lawlor ..... 473/257
5,156,403 A * 10/1992 Martino ..... 473/278
5,743,819 A * 4/1998 Chun ..... 473/386
5,967,909 A * 10/1999 Broadbridge ..... 473/386
6,024,654 A * 2/2000 Chun ..... 473/386
6,086,486 A * 7/2000 Murphy et al. ..... 473/397

* cited by examiner

*Primary Examiner*—Steven Wong
(74) *Attorney, Agent, or Firm*—Raymond Y. Chan; David and Raymond Patent Group

(57) ABSTRACT

A golf range tee includes a hollow supporting frame and a retention arrangement. The supporting frame has an upper end and a lower end, and defining a holding channel extending from the upper end towards the lower end for a shaft of the golf tee to slidably insert into the holding channel so as to selectively adjust a height a cup of the golf tee with respect to the ground. The retention arrangement has a sliding slot radially formed at the supporting frame from the upper end thereof to communicate the holding channel with an exterior of the supporting frame. Therefore, when an impact force is applied at the golf tee, the golf tee is forced to slide from the holding channel through the sliding slot so as to distribute the impact force at the golf tee to prevent the golf tee from being broken.

4 Claims, 4 Drawing Sheets

GOLF RANGE TEE

BACKGROUND OF THE PRESENT INVENTION

1. Field of Invention

The present invention relates to a golf accessory, and more particularly to a golf range tee, wherein a golf tee is detachably inserted into the golf range tee to selectively adjust a height of a golf ball being tee-up from the ground while the golf tee is slid to offset to the golf range tee after the impact of the golf ball so as to prevent the golf tee from being broken upon the impact.

2. Description of Related Arts

Golfers practice to improve. Generally, golfers go to driving range for practice. Most driving ranges nowadays use mats instead of growing real grass for the simple reason of keep maintenance cost low. A rubber tee is inserted through an opening in the mat such that when a golfer wants to tee up the ball, he or she is able to place the golf ball on the rubber tee, as shown in FIG. 1A.

Most mats are about 1 inch thick and therefore the rubber tees are at least one and a half inches long. They vary in length, with existing rubber tees range from one and a half inches to three inches long. Depending on how high the golfer wants to tee up the ball, the golfer chooses a rubber tee of specific length. Most of the time, the rubber tee is used when the golfer practices with his/her driver when the ball must be hit off a tee.

With the introduction of oversize titanium driver, the size of drivers can be as big as 460 cc in volume. Some non-conforming models are even bigger. However, a lot of golfers prefer drivers that are smaller in size. It creates a situation where the sizes to drivers vary from 200 cc to 460 cc in volume. It seems like whenever a golfer go to a driving range, the golfer can never find a rubber tee having a desired length. Driving range operators usually offer rubber tees free of charge to their customers. However, it is difficult for them to provide rubber tees of every different length to satisfy every customer. It is because every golfer has a different size driver and may want to tee up the ball at a different height. A lot of times, a golfer practices hitting their driver without teeing the ball at the correct height. The ball is teed up either too high or too low, which produces undersirable results.

Golfers should practice their golf shots the same way they would hit the shot when they are on the golf course. This includes teeing the ball the same height on the driving range and out on the golf course. However, when golfers go to the driving range and cannot find the right rubber tee to tee up the ball correctly, they live with this "bearable" inconvenience. After all, they can still hit the ball if the tee is slightly too high or too low to their liking. They may adjust their swing a little bit to accommodate the ball flight resulting from a ball teed too high or too low. It is a small problem but one that will nullify the practice the golfer puts in.

Rubber tees on the market now are being offered in half inch increments, one and a half inches, two inches, two and a half inches and three inches. What if a golfer wants to tee up the ball at two and a quarter inches? Or practice one shot at a low tee height and the next a much higher tee height? The present rubber tees are just not flexible enough to allow a golfer to do this.

It is worth to mention that golfers should practice their golf shots the same way they would hit the shot with the wooden golf tee when they are on the golf course. The feeling of hitting golf club at the rubber tee as shown in FIG. 1A is different from the feeling of hitting golf club at the wooden golf tee. Also, there is no practice of the motion or pre-shot routine of actually putting the ball and tee in one's hand and inserting the tee into the ground when practicing with the rubber tee since the golf tee cannot directly be inserted into the mat.

An improved golf range tee 10B appeared in the market for a while, as shown in FIG. 1B, which has a rubber base 11B retained under the mat, a rubber tee tube 12B upwardly extended above the mat for about one inch, and a plurality of gripping muscles 13B integrally and inwardly protruded from an inner wall of the rubber tee tube 12B, wherein the golfer is able to insert a wooden golf tee 1B into the top opening of the rubber tee tube 12B until the gripping muscles 13B firmly mount the wooden golf tee 1B therebetween, such that the golfer is able to adjust the height of the wooden golf tee 1B by sliding up and down between the gripping muscles 13B.

Most golfers have standard golf wooden golf tees that are 2⅛ to 3½ inches. In other words, there is about 1¼ inches above the mat for 200 cc drivers and 2½ inches above the mat for 460 cc drivers. If the golfer wants to tee up the golf ball even higher, he or she merely uses a higher golf tee that are available up to 3¼ inches from the golf shops. However, when the golf club properly hits the golf ball, the impact force of the golf club applies not only on golf ball but also at the wooden golf tee. In the golf course, the golf tee will fly off from the grass after the golf ball is hit. However, in the driving range, when the golf ball is hit with a proper golf swing, the wooden golf tee mounted on such conventional golf range tee will be broken at the impact, as shown in FIG. 1B. Therefore, the broken bottom portion of the wood golf tee 1B which is still firmly gripped between the gripping muscles 13B must be removed from the rubber tee tube 12B so that the golfer can insert and mount another new wooden golf tee to the rubber tee tube 12B.

Accordingly, for starter golfers who fail to swing their clubs properly or topping the golf ball, they may generally have chance to keep the wooden golf tee 1B for a longer period of time. To golfers having average skill, they may break the wooden golf tee 1B in every practice swing. It is very troublesome to take out the golf range tee 10B from the mat in order to remove the broken bottom portion of the wooden golf tee 1B and then replace the golf range tee 10B on the mat again after every or couple golf swings. That is the reason that such golf range tee 10B is not popular in market.

SUMMARY OF THE PRESENT INVENTION

A main object of the present invention is to provide a golf range tee, in which a golf tee can be securely mounted at the golf range tee to adjust a height of the golf ball being teed up while the golf tee is detached from the golf range tee after the golf ball is hit to prevent the golf tee from being broken.

Another object of the present invention is to provide a golf range tee, wherein the golf range tee has a holding channel for a golf tee to be inserted thereinto such that the golf tee can be selectively adjusted a height of a golf ball with respect to the ground. Therefore, the golfer is able to adjust the height of the golf tee corresponding to the personal preference such as the size of the driver.

Another object of the present invention is to provide a golf range tee, wherein the golf range tee has a sliding slot radially extended from the holding channel such that the golf tee is slid along the sliding slot from the holding channel after the impact of the golf ball so as to prevent the golf tee from being broken upon the impact thereof. In other words, the golf tee will slide offset from the sliding slot after the golf ball is hit as if the same feeling of hitting the golf ball off the wooden golf tee on the golf course.

Another object of the present invention is to provide a golf range tee, which further has a holding muscle provided at an inner wall of the holding channel to securely hold the golf tee within the holding channel.

Another object of the present invention is to provide a golf range tee, wherein a hitting guider is provided at the tee base to align with the sliding slot for guiding the hitting direction of the golf ball. In other words, when the golfer hits the golf ball at the hitting direction, the golf tee will slide along the sliding slot to prevent the breakage of the golf tee.

Another object of the present invention is to provide a golf range tee, which can be used on the mat of the driving range such that the golfer is able to practice the swing, especially the driver, at the driving range as if the swing on the golf course.

Another object of the present invention is to provide a golf range tee, which does not involve any expensive or complicated electrical or mechanical components so as to minimize the manufacturing cost of the present invention.

Another object of the present invention is to provide a golf range tee, wherein no expensive or complicated mechanical structure is required to employ in the present invention in order to achieve the above mentioned objects. Therefore, the present invention successfully provides an economic and efficient solution not only for providing a golf range tee to support the golf tee with height adjustment but also for preventing the golf tee from being broken after the golf ball is hit.

Accordingly, in order to accomplish the above objects, the present invention provides a golf range tee for supporting a golf tee, comprising:

a hollow supporting frame having an upper end and a lower end, and defining a holding channel extending from the upper end towards the lower end for a shaft of the golf tee to slidably insert into the holding channel so as to selectively adjust a height a cup of the golf tee with respect to the ground; and a retention arrangement having a sliding slot radially formed at the supporting frame from the upper end thereof to communicate the holding channel with an exterior of the supporting frame, whereby when an impact force is applied at the golf tee, the golf tee is forced to slide from the holding channel through the sliding slot so as to distribute the impact force at the golf tee to prevent the golf tee from being broken.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
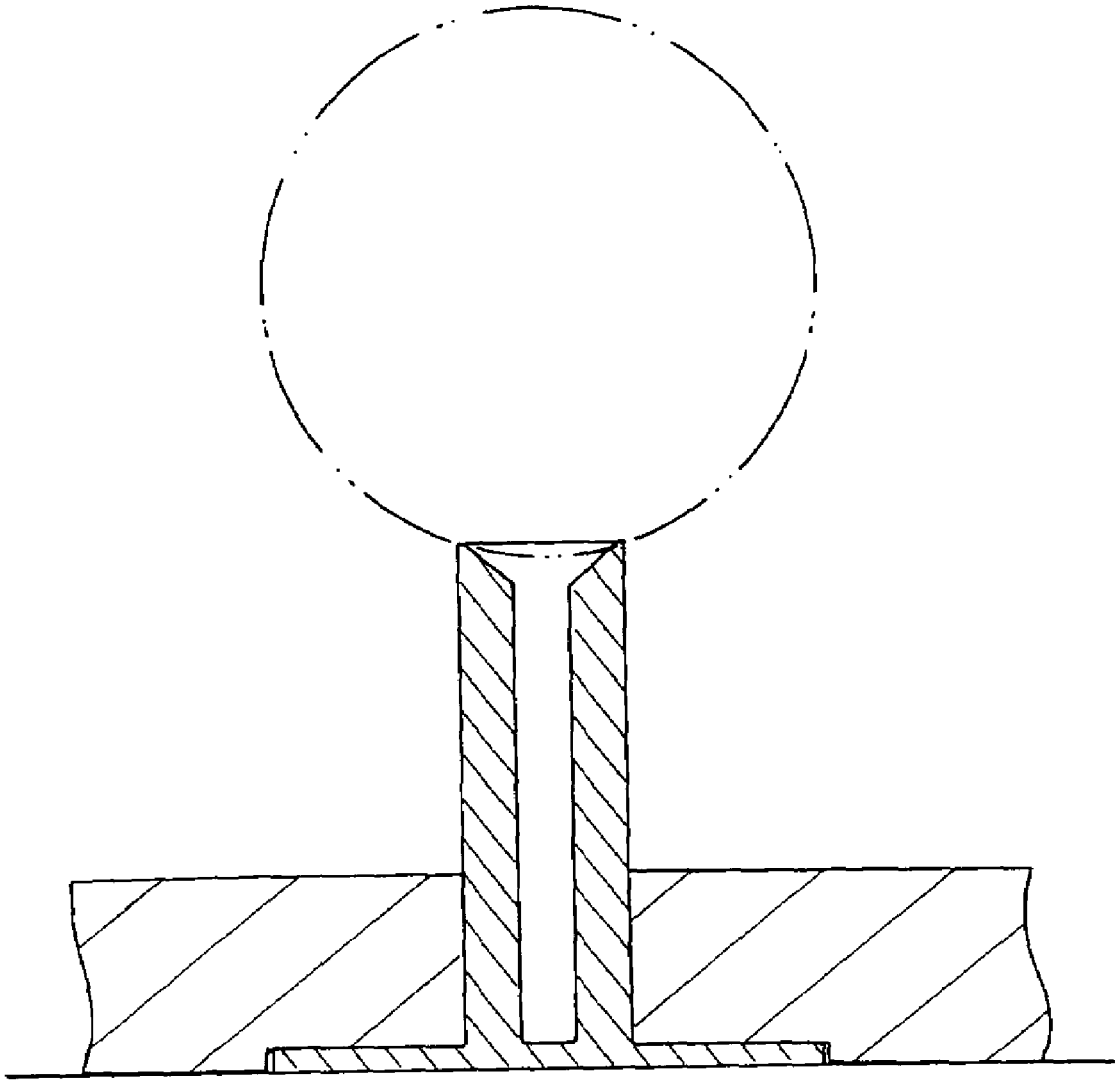
FIG. 1A PRIOR ART
FIG. 1 is a sectional view of a conventional golf range tee.
Figure 1B:
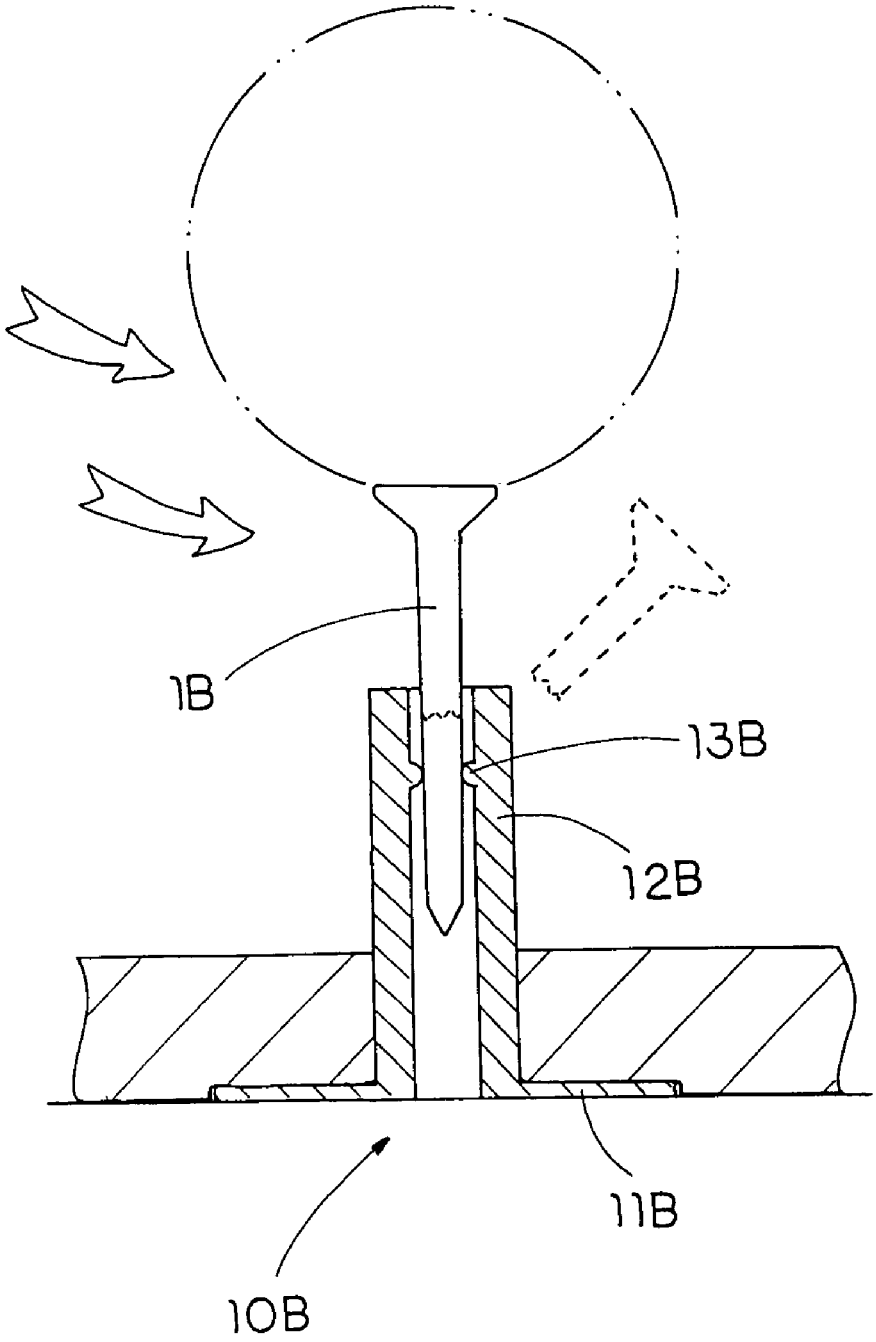
FIG. 1B PRIOR ART
Figure 2:
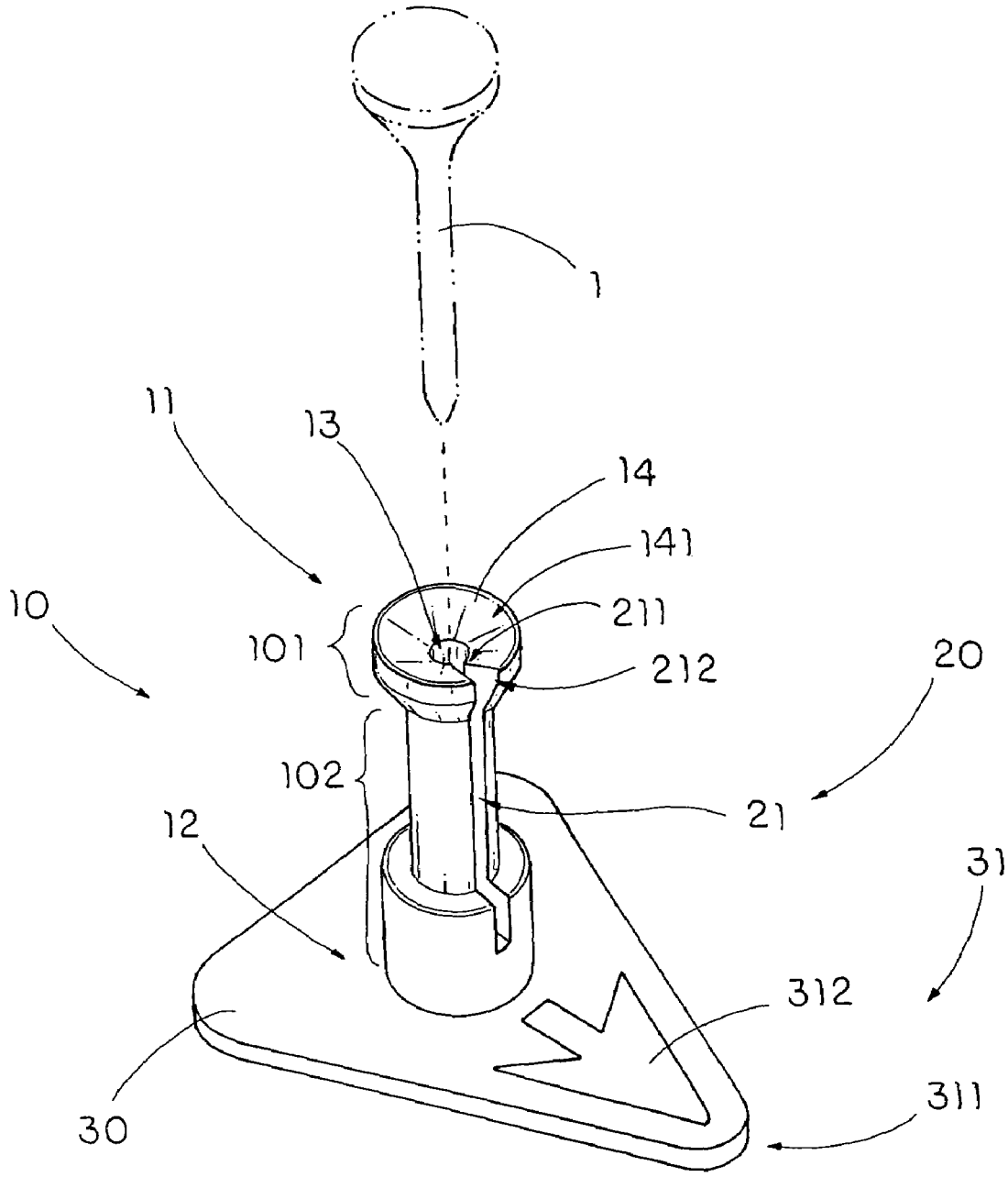
FIG. 2 is a perspective view of a golf range tee according to a preferred embodiment of the present invention.
Figure 3:
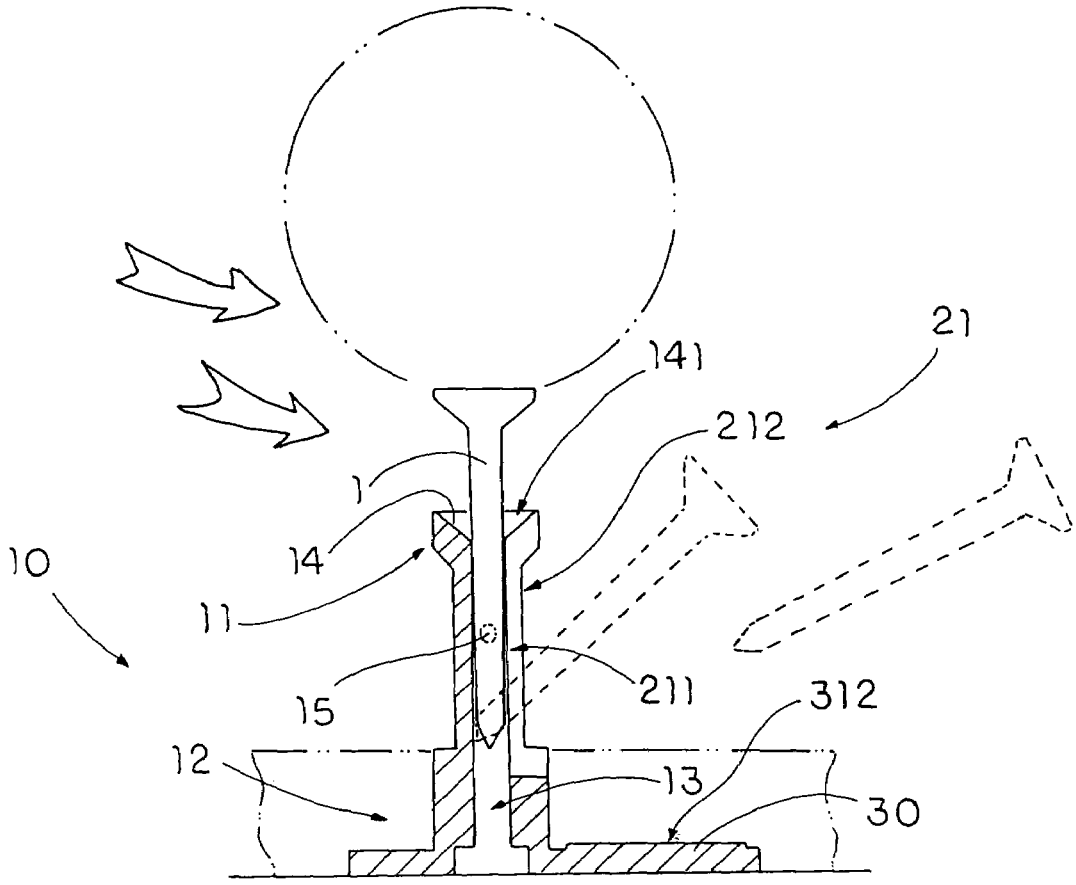
FIG. 3 is a sectional view of the golf range tee according to the above preferred embodiment of the present invention, illustrating the golf tee being slid at the sliding slot.

Referring to FIGS. 2 and 3 of the drawings, a golf range tee for supporting a golf tee 1 according to a preferred embodiment of the present invention is illustrated, wherein the golf range tee comprises a hollow supporting frame 10 and a retention arrangement 20.

The supporting frame 10 has an upper end 11 and a lower end 12, and defining a holding channel 13 extending from the upper end 11 towards the lower end 12 for a shaft of the golf tee 1 to slidably insert into the holding channel 13 so as to selectively adjust a height a cup of the golf tee 1 with respect to the ground level.

The retention arrangement 20 has a sliding slot 21 radially formed at the supporting frame 10 from the upper end 11 thereof to communicate the holding channel 13 with an exterior of the supporting frame 10. Therefore, when an impact force is applied at the golf tee 1, the golf tee 1 is forced to slide from the holding channel 13 through the sliding slot 21 so as to distribute the impact force at the golf tee 1 to prevent the golf tee 1 from being broken.

According to the preferred embodiment, the supporting frame 10 is made of durable and elastic material such as rubber and is arranged to upwardly extend from the ground. It is worth to mention that the golf range tee of the present invention is used in the golf driving range such that the supporting frame 10 is upwardly extended from the mat used in the golf driving range.

The holding channel 13 is a circular channel coaxially formed on the supporting frame 10 from the upper end 11 thereof wherein the holding channel 13 has a size slightly smaller than a diameter of the shaft of the golf tee 1 such that an inner wall of the holding channel 13 is adapted for frictionally holding the golf tee 1 in position when the golf tee 1 is slidably inserted into the holding channel 13. In other words, the golf tee 1 is adapted to be slid vertically along the holding channel 13 to selectively adjust a distance of the cup of the golf tee 1 with respect to the ground, i.e. the mat.

The sliding slot 21 is radially extended from the supporting frame 10 to form an inner opening 211 at the inner wall thereof to communicate with the holding channel 13 and an outer opening 212 at an outer wall of the supporting frame 10, wherein a width of the inner opening 211 is smaller than that of the outer opening 212. Accordingly, the outer opening 212.

Preferably, the sliding slot 21, having a predetermined length, is extended from the upper end 11 of the supporting frame 10 towards the lower end 12 thereof at a position that when the shaft of the golf tee 1 is inserted into the holding channel 13, a bottom end of the golf tee 1 is positioned above a bottom edge of the sliding slot 21 so as to prevent the golf tee 1 from being broken when the golf tee 1 is slid out from the sliding slot 21.

According to the preferred embodiment, when the golf tee 1 is slidably inserted into the holding channel 13, the sliding slot 21 will be forced to slightly increase its width to self-adjust a diameter of the holding channel 13 so as to securely hold the golf tee 1 in position. In other words, the sliding slot 21 allows the holding channel 13 to be slightly deformed to fit the size of the golf tee 1, such that different sizes of the golf tee 1 can be used to insert into the holding channel 13 that the inner wall of the holding channel 13 is adapted for frictionally holding the golf tee 1 in position.

In addition, when the impact force is applied on the golf tee 1 aligning with the sliding slot 21, the golf tee 1 is adapted to slide towards the sliding slot 21 from the holding channel 13 so as to distribute the impact force directly on the golf tee 1. If the impact force is relatively small, the golf tee 1 is pushed at a slant position that a portion of the golf tee 1 is held at the inner opening 211 of the sliding slot 21 so as to retain the golf tee 1 at the golf range tee as shown in FIG. 3. Once the impact force is large enough to slide the golf tee 1 out of the inner opening 211 of the sliding slot 21, the golf tee 1 will detach from the supporting frame 10 so as to prevent the golf tee 1 from being broken, as shown in FIG. 3.

In order to ensure the golf tee 1 being held in position, the supporting frame 10 further has at least a holding muscle 15 formed on the inner wall of the supporting frame 10 within the holding channel 13 for substantially biasing against the shaft of the golf tee 1. Accordingly, the holding muscle 15 is preferably made of elastic material such as rubber adapted to be slightly deformed such that when the shaft of the golf tee 1 is inserted into the holding channel 13, the shaft of the golf tee 1 is substantially held by the holding muscle 15.

As shown in FIGS. 2 and 3, the supporting frame 10 further has an inclined top ceiling 14 formed at the upper end 11 thereof wherein the top ceiling 14 is inclinedly and downwardly extended towards to the holding channel 13 to form a golf ball cavity 141 for supporting a golf ball thereon. Therefore, the golf range tee of the present invention can be used as a conventional rubber tee to tee up the golf ball without the golf tee 1 inserted into the holding channel 13. In other words, the golfer is able to tee up the golf ball by either using the golf tee 1 inserted into holding channel 13 or directing placing the golf ball on the top ceiling 14 of the supporting frame 10.

Preferably, the supporting frame 10 has an enlarged head portion 101 forming the top ceiling 14 for securely supporting the golf ball thereon and an elongated body portion 102 integrally extended from the head portion 101 for holding the golf tee 1 in position, as shown in FIG. 3.

According to the preferred embodiment, the golf range tee further comprises a tee base 30 supporting the supporting frame 10 thereon wherein the tee base 30 has a hitting guider 31 formed thereon to align with the sliding slot 21 for guiding a hitting direction of the golf ball, i.e. the direction of the impact force. As shown in FIG. 3, the holding channel 13 is extended from the upper end 11 of the supporting frame 10 to a bottom side of the tee base 30 such that if the golf tee 1 is accidentally broken within the holding channel 13, the golfer is able to pull of the broken portion of the golf tee 1 easily.

Figure 4:
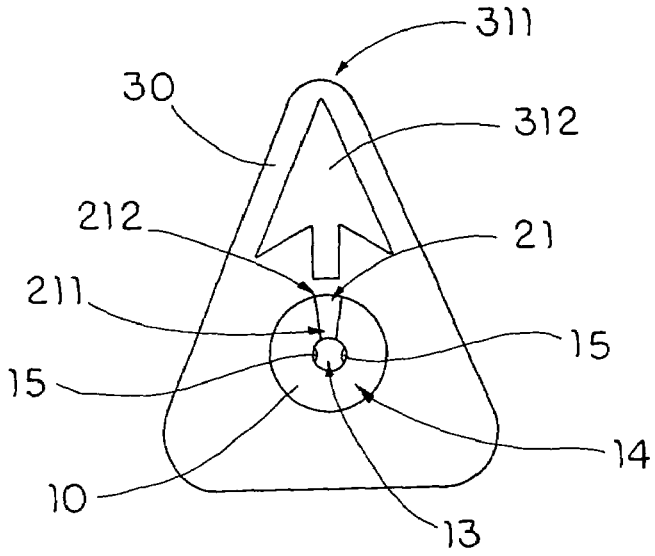
FIG. 4 is a top view of the golf range tee according to the above preferred embodiment of present invention.

As shown in FIG. 4, the tee base 30 has an isosceles triangular shape to form a guiding corner 311 between two equal lengths of the tee base 30, wherein the guiding corner 311 is embodied as the hitting guider 31 aligning with the sliding slot 21. Therefore, when the impact force is applied on the golf tee 1 at a direction towards the guiding corner 311 of the tee base 30, the golf tee 1 is pushed out of the holding channel 13 along the sliding slot 21. In other words, the hitting guider 31 ensures the forward sliding movement of the golf tee 1 after the golf ball is hit. Since the golfer always want to hit the golf ball at the forward direction, the hitting guider 31 can guide the golfer to aim the hitting direction forward while the sliding slot 21 can check whether the golf ball is hit forward by the position of the golf tee 1.

Alternatively, the hitting guider 31 is a direction mark 312, having an arrow-head shape, formed on the tee base 30 to align with the sliding slot 21 for guiding the hitting direction of the golf ball. It is worth to mention that the direction mark 312 can be provided on the base tee 30 having an irregular shape to align with the sliding slot 21 for guiding the hitting direction of the golf ball. As shown in FIG. 4, the direction mark 312 is preferably provided on the tee base 30 pointing at the guiding corner 311 thereof such that the golfer is able to aim the hitting direction by the direction mark 312 and/or the guiding corner 311 of the tee base 30.

The golf range tee of the present invention substantially solves the conventional problems of being non-adjustable in tee-up height and failing to provide pre-shot routine of teeing up the golf ball with wood tee. The golf range tee of the present invention is designed to be a rubber tee having a height about two inches that will allow the golfer to insert a wood tee into the holding channel 13 in the middle of the supporting frame 10 to increase the height of the tee. The holding channel 13 is designed to allow for the wood tee to go up and down in the middle holding channel 13 to adjust the total height of the tee. Most golfers have standard wood tees that are 2 and ⅛ inches so the addition of the wood tee will allow a golfer to tee up the ball anywhere from 2 and ⅛ inches to 3½ inches. This translates to about 1¼ inches above the mat for 200 cc drivers and 2½ inches above the mat for 460 cc drivers. If the golfer wants to tee up the ball even higher, he or she can just use a higher wood tee, which is now readily available up to 3¼ inches from golf shops.

In view of above, the golf range tee of the present invention is capable of allowing a golfer to achieve a more satisfying practice session with the driver and woods from the tee box.

(1) The middle holding channel 13 with the sliding slot 21 in the front of the supporting frame 10. Most wood tees have a diameter of about 4.5 mm, the sliding slot 21, which is a cylindrical opening in the middle of the holding channel 13 from top to bottom, is 4 mm in diameter. This slightly smaller diameter, together with the sliding slot 21 in front of the supporting frame 10 is designed to grab the wood tee 1 and hold it at the desired height. This allows the golfer to insert a wood tee 1 and adjust the height according to his or her desirability.

(2) The sliding slot 21 in front of the supporting frame 10 is designed to allow the wood tee 1 to go forward and avoid breakage upon the impact of the golf ball by the golf club. Without this sliding slot 21, there is certainty that the inserted wood tee will break upon impact because of the high speed at which the driver is hitting into the golf ball.

(3) The triangular tee base 30 is another unique design of the present invention. While all rubber tees on the market has a round tee base, the triangular tee base with an arrow shape direction mark 312 on the top surface indicates the direction of the tee. This distinct shape clearly indicates to the golfer to align the rubber tee in the correct direction with the sliding slot 21 in the front position.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A golf range tee for supporting a golf tee to tee up a golf ball, comprising:

a hollow supporting frame having an upper end and a lower end, and defining a holding channel extending from said upper end towards said lower end for the golf tee to slidably insert into said holding channel so as to selectively adjust a height of the golf tee with respect to a ground level, wherein said holding channel is a circular channel coaxially formed on said supporting frame from said upper end thereof, wherein said holding channel has a size slightly smaller than a diameter of said shaft of the golf tee, such that said inner wall of said holding channel is adapted for frictionally holding the golf tee in position when the golf tee is slidably inserted into said holding channel, wherein said supporting frame further has an inclined top ceiling formed at said upper end thereof, wherein said top ceiling is inclinedly and downwardly extended towards to said holding channel to form a golf ball cavity for supporting the golf ball thereon;

a retention arrangement having a sliding slot radially formed at said supporting frame to extend from said upper end towards said lower end, wherein said sliding slot has an inner opening formed at an inner wall of said supporting frame to communicate with said holding channel and an outer opening formed at an outer wall of said supporting frame such that said holding channel communicates with an exterior of said supporting frame through said sliding slot, wherein a width of said inner opening is smaller than that of said outer opening, wherein said supporting frame is made of elastic material that said sliding slot is adapted to be forced to slightly increase a width thereof to self-adjust a diameter of said holding channel for securely holding the golf tee in position when the golf tee is slidably inserted into said holding channel; and a tee base supporting said supporting frame thereon, wherein said tee base has a hitting guider formed thereon to align with said sliding slot for guiding a hitting direction of the golf ball;

whereby when an impact force is applied at the golf tee, the golf tee is forced to slide from said holding channel through said sliding slot so as to distribute said impact force at the golf tee.

2. The golf range tee, as recited in claim 1, wherein said supporting frame further has at least a holding muscle formed on said inner wall of said supporting frame within said holding channel for substantially biasing against the golf tee so as to ensure the golf tee being held in position.

3. A golf range tee for supporting a golf tee to tee up a golf ball, comprising:

a hollow supporting frame having an upper end and a lower end, and defining a holding channel extending from said upper end towards said lower end for the golf tee to slidably insert into said holding channel so as to selectively adjust a height of the golf tee with respect to a ground level, wherein said holding channel is a circular channel coaxially formed on said supporting frame from said upper end thereof, wherein said holding channel has a size slightly smaller than a diameter of said shaft of the golf tee, such that said inner wall of said holding channel is adapted for frictionally holding the golf tee in position when the golf tee is slidably inserted into said holding channel, wherein said supporting frame further has at least a holding muscle formed on said inner wall of said supporting frame within said holding channel for substantially biasing against the golf tee so as to ensure the golf tee being held in position; and a retention arrangement having a sliding slot radially formed at said supporting frame to extend from said upper end towards said lower end, wherein said sliding slot has an inner opening formed at an inner wall of said supporting frame to communicate with said holding channel and an outer opening formed at an outer wall of said supporting frame such that said holding channel communicates with an exterior of said supporting frame through said sliding slot, wherein a width of said inner opening is smaller than that of said outer opening, wherein said supporting frame is made of elastic material that said sliding slot is adapted to be forced to slightly increase a width thereof to self-adjust a diameter of said holding channel for securely holding the golf tee in position when the golf tee is slidably inserted into said holding channel;

whereby when an impact force is applied at the golf tee, the golf tee is forced to slide from said holding channel through said sliding slot so as to distribute said impact force at the golf tee.

4. A golf range tee for supporting a golf tee to tee up a golf ball, comprising:

a hollow supporting frame having an upper end and a lower end, and defining a holding channel extending from said upper end towards said lower end for the golf tee to slidably insert into said holding channel so as to selectively adjust a height of the golf tee with respect to a ground level, wherein said holding channel is a circular channel coaxially formed on said supporting frame from said upper end thereof, wherein said holding channel has a size slightly smaller than a diameter of said shaft of the golf tee, such that said inner wall of said holding channel is adapted for frictionally holding the golf tee in position when the golf tee is slidably inserted into said holding channel, wherein said supporting frame further has at least a holding muscle formed on said inner wall of said supporting frame within said holding channel for substantially biasing against the golf tee so as to ensure the golf tee being held in position;

a retention arrangement having a sliding slot radially formed at said supporting frame to extend from said upper end towards said lower end, wherein said sliding slot has an inner opening formed at an inner wall of said supporting frame to communicate with said holding channel and an outer opening formed at an outer wall of said supporting frame such that said holding channel communicates with an exterior of said supporting frame through said sliding slot, wherein a width of said inner opening is smaller than that of said outer opening, wherein said supporting frame is made of elastic material that said sliding slot is adapted to be forced to slightly increase a width thereof to self-adjust a diameter of said holding channel for securely holding the golf tee in position when the golf tee is slidably inserted into said holding channel; and a tee base supporting said supporting frame thereon, wherein said tee base has a hitting guider formed thereon to align with said sliding slot for guiding a hitting direction of the golf ball;

whereby when an impact force is applied at the golf tee, the golf tee is forced to slide from said holding channel through said sliding slot so as to distribute said impact force at the golf tee.

* * * * *